United States Patent [19]

Romania et al.

[11] 3,987,823

[45] Oct. 26, 1976

[54] RETRACTABLE WIRE GUIDE FOR WIRE WRAP GUN

[75] Inventors: Samuel Richard Romania; George Joseph Sprenkle, both of Phoenixville, Pa.

[73] Assignee: Burroughs Corporation, Detroit, Mich.

[22] Filed: Nov. 28, 1975

[21] Appl. No.: 635,870

[52] U.S. Cl. ..... 140/124; 29/203 H; 140/119

[51] Int. Cl.[2] ..... B21F 15/00

[58] Field of Search ..... 140/124, 119, 149; 29/203 H, 203 HC

[56] References Cited

UNITED STATES PATENTS

| | | | |
|---|---|---|---|
| 3,716,080 | 2/1973 | Scaddan et al. | 140/124 |
| 3,788,367 | 1/1974 | Ackerman | 140/124 |

*Primary Examiner*—Travis S. McGehee
*Attorney, Agent, or Firm*—K. R. Peterson; Edward J. Feeney, Jr.; Francis A. Varallo

[57] ABSTRACT

The present disclosure describes a wire guide for use with a manually operated wire wrap gun. Such guns are used to make solderless wrapped connections on terminals emanating from a circuit board. The wire guide of the present invention is especially useful with multi-spindle guns, such as the dual spindle gun utilized for simultaneously wrapping both wires of a twisted pair or miniature coaxial cable. The present wire guide which is fastened to the sleeve portion of the gun, permits the operator to front load the gun quickly and reliably by directing the multiple wires into the respective wire feed openings of the wrapping tool bits housed within the sleeves. Thus, the guide eliminates the tedious task of inserting wires into the gun even when the feed openings are visible to the operator; and of greater importance, it is indispensable in a front loading operation where the gun is in a fixed mounted position directed away from the operator and the openings cannot be seen, as is the case with semi-automated numerical positioning systems.

7 Claims, 6 Drawing Figures

RETRACTABLE WIRE GUIDE FOR WIRE WRAP GUN

BACKGROUND OF THE INVENTION

Wire wrap machines and guns for attaching interconnecting wiring to terminals arranged on a panel or board by means of solderless wrapped connections are well known in the electronic and electrical industries. While much of the wiring is accomplished by automatic machines, there remains a considerable wiring effort which must be accomplished either manually or semi-automatically, the latter involving machines which determine the multiplicity of positions at which the connections are to be made. In connection with the latter modes of operation, the operator is required to insert the wire to be wrapped into the proper opening in the wire wrap gun for each connection to be made. In the case of multiple wires such as twisted pair or miniature coaxial, the operator must insert both wires into the respective wire feed openings in the gun wrapping bits. If in an actual embodiment the connection board has a high terminal density, for example, terminals spaced on 0.10 inch centers, it will be appreciated that interconnect wire of very small diameter, such as No. 30 gauge must be used. The wrapping bits are cylindrical and contain in their periphery a slot to receive the wires to be wrapped. The central or terminal aperture of the bit receives the terminal during wrapping. Typically, in the above mentioned embodiment, the terminal cross-section is 0.025 inches square. Since the wire feed openings are very small, being approximately only one third the diameter of the terminal apertures, it is a tedious task to insert the fine wires into the feed openings, while avoiding the terminal apertures. Thus far, it has been assumed that the operator is able to see the feed openings. However, in a numerical positioning system, for example, the gun mounting is fixed and the gun is pointed away from the operator. Under these conditions, it is extremely difficult, if not impossible, to front-load the gun. It is apparent that some means is needed to assist the operator in this task. The wire guide of the present invention fills this important need.

SUMMARY OF THE INVENTION

In accordance with the present invention, a wire guide is provided to facilitate the front-loading of a wire wrap gun.

The guide is comprised of two parts. The first of these parts is a wire retaining block which is rigidly mounted to the sleeves of the multi-spindle gun. For purposes of this description, the gun is considered to be of the dual-spindle type, although it will be apparent that the present device could readily be adapted for use with a wire wrap gun having a single spindle or more than two spindles. The second part of the wire guide includes the actual guide member, the latter being hinged and pivoting from the wire retaining block. Two slots are provided in the guide member for receiving the twin wires to be wrapped. After the guide member is moved into the load position, that is, into proximity with the wrapping tool bits, the ends of the wires are fed simultaneously into the slots where they are automatically directed into the respective wire feed openings of the bits. The central apertures in the bits which receive the terminals during the wrapping operation, are closed-off by the guide member during loading to insure that the wires being inserted will not be misdirected into these apertures. After the insertion procedure, the guide member is permitted to retract, thereby clearing the wrapping bits for engagement with the terminals. At the same time, the dual wire is routed back through a groove provided in the retainer block. It is to be noted that the entire wire insertion process is easily performed using the present device, even when the viewing of the wrapping bits is not possible.

Other features and advantages of the present invention will become apparent in the detailed description appearing hereinafter.

DESCRIPTION OF THE PREFERRED EMBODIMENT

Figure 1:
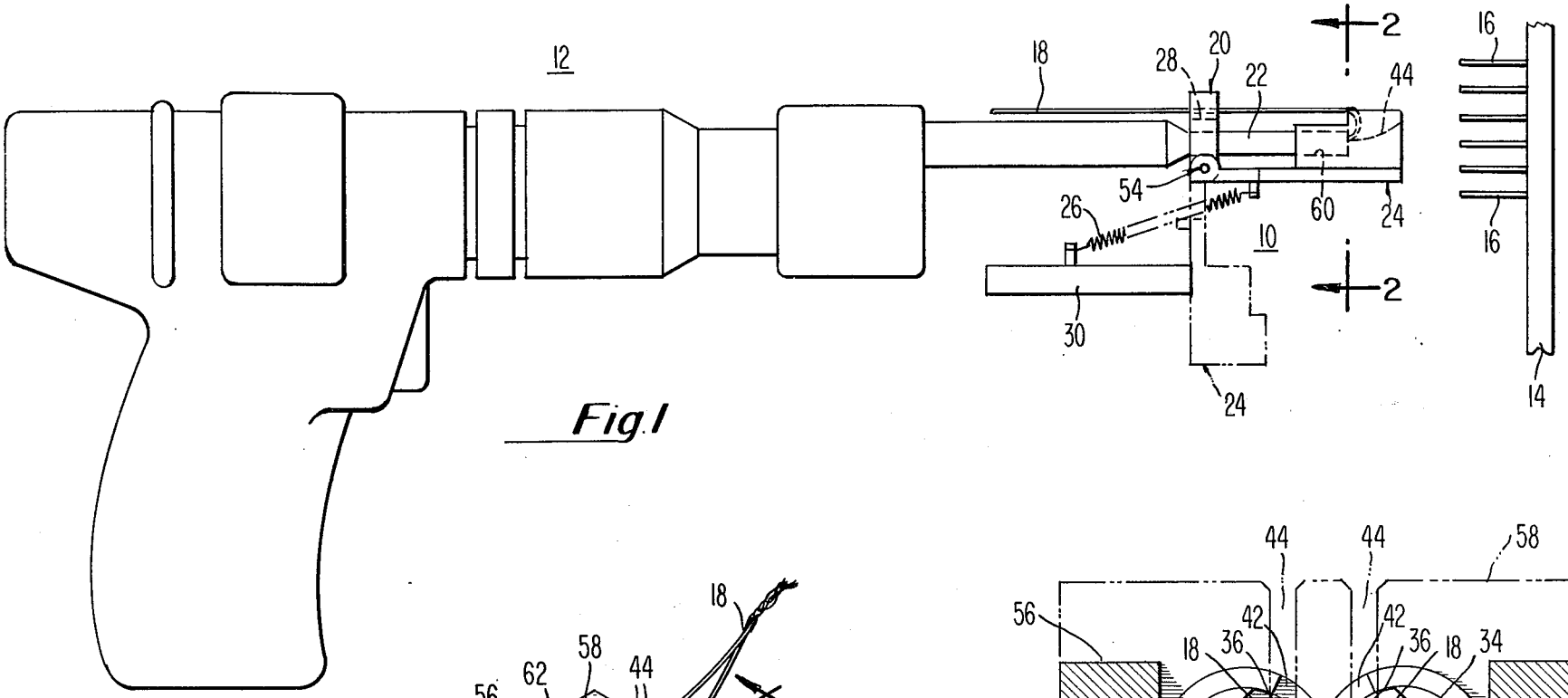
FIG. 1 is a view of the wire guide shown mounted on a wire wrap gun.

FIG. 1 illustrates the wire guide 10 of the present invention mounted on a typical wire wrap gun 12, which for purposes of example is assumed to be moveable in a horizontal plane. A panel or board 14 mounted in a vertical plane in proximity to the gun has a plurality of terminals 16 emanating therefrom. It is assumed that the gun is of the dual spindle type, in which a pair of wires 18, such as twisted pair or coaxial may be wrapped simultaneously. As pointed out hereinbefore, the present invention is not to be considered limited to the dual spindle variety of gun. In an actual operative environment, the terminals 16 are .025 inches square in cross section and are spaced 0.10 inches apart. The wire 18 is No. 30 gauge.

Figure 2:
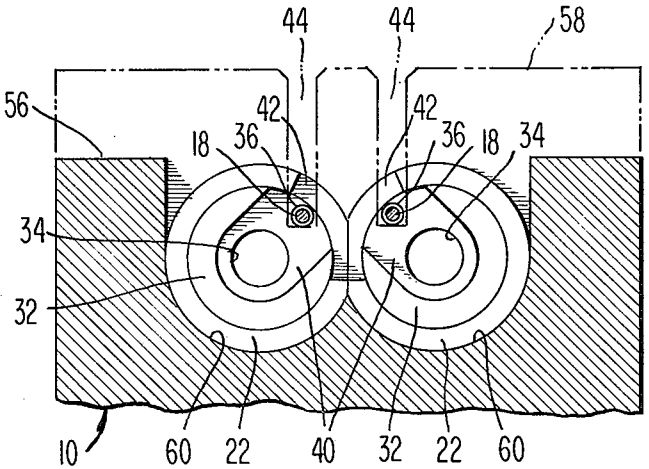
FIG. 2 is a section view taken along lines 2—2 of FIG. 1 and depicting the front end of the wrap gun including the wrapping bits.

The wire guide 10 is comprised of two major parts, the first of which is a wire retaining block 20 shown affixed to the sleeves 22 of the gun 12. The second part is the guide member 24 which is shown in the load position, that is pushed upward in opposition to the spring 26 so that it contacts the sleeves 22. After wires 18 have been inserted, the guide member 24 is released and the spring 26 pulls it downward to the position shown in phantom in FIG. 1. This exposes the end of the gun 12, as seen in FIG. 2, and permits the gun to be moved over the terminals 16 to effect the wrapping process. The wires 18 are routed back through a groove 28 in the block 20. One extremity of the spring 26 is shown affixed to the guide member 24, while the other extremity is fastened to a stationary piece 30. It should be noted that the latter may be a portion of the platform on which the gun is mounted, as in the case of an automated numerical positioning system, or the spring may be fastened to the frame of the gun itself in a hand-held operation.

FIG. 2 shows the end of the gun 12. The dual sleeves 22 house respectively the wrapping tool bits 32, which are rotated by the gun to effect the electrical connection. Each bit 32 is cylindrical in shape and includes a central aperture 34 which is adapted to enclose the terminal 16 being wrapped, and an external wire feed opening 36 of a slot 38 along the longitudinal periphery of the bit which holds the portion of the wire to be wrapped. The slot 38 in wrapping bit 32 is shown in detail in FIG. 4. Each of the bits also has a recessed region 40, and the sleeves have a cut away portion 42 to better accommodate the wire after insertion, that is, to lesssen the sharpness of the bend in the wire as it is routed back toward the gun, and at the same time minimize the protrusion of the wire beyond the end of the gun. It should be noted that the wire wrap gun utilized with the wire guide of the present invention is assumed to have an integral wrapping bit positioning feature which stops the bit rotation at the same predetermined location after each wrap. Thus, the wire feed openings 36 in the bits 32 appear at the same position for each wire loading operation.

When the guide member 24 is in the load position as seen in FIG. 2 the terminal apertures 34 in the wrapping bits 32 are blocked by the guide to prevent the inadvertent insertion of a wire into the aperture.

Figure 3:
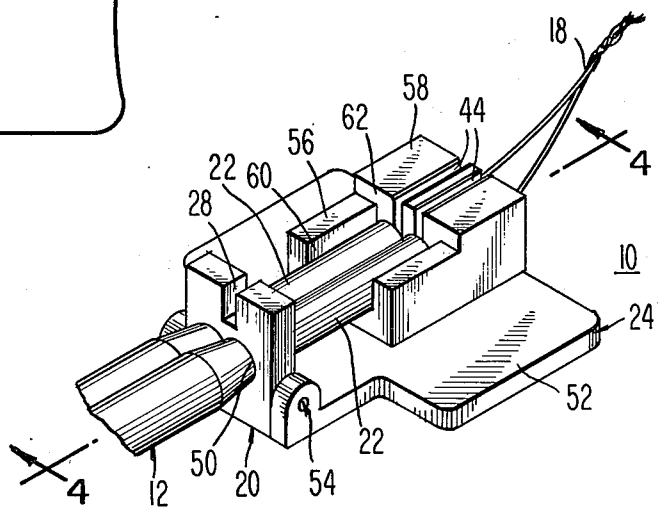
FIG. 3 is a pictorial illustration of the wire guide shown in relation to the sleeves of the wire wrap gun.
Figure 4:
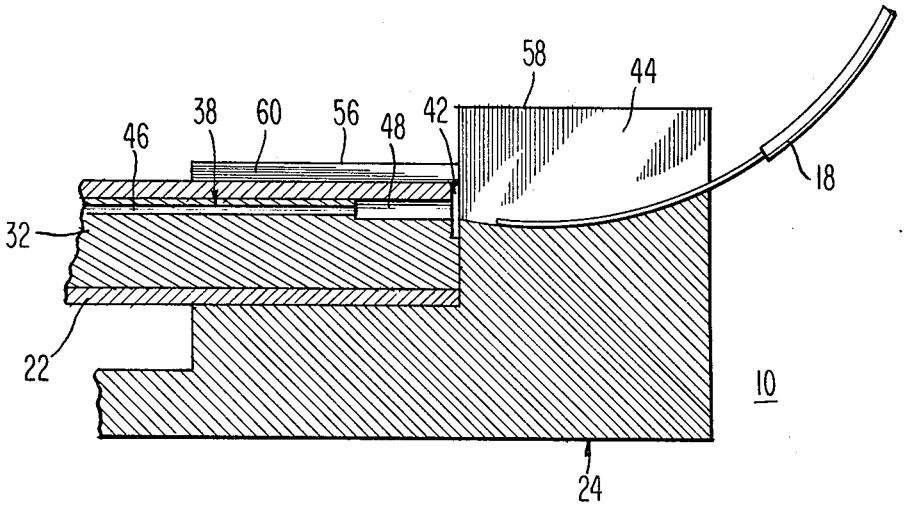
FIG. 4 is a section view taken along lines 4—4 of FIG. 3 showing the insertion path of the wire, through the guide and into the feed opening provided in the wrapping bit.

With reference to FIG. 3, the wires 18 to be wrapped are inserted simultaneously by the operator into the slots 44 of the guide member 24 where they are directed into the wire feed openings 36 of the bits 32 as seen in FIG. 2. The bottom of each of the slots 44 has an arcuate shape as seen in FIG. 4 which directs the wire in an upward trajectory, thereby facilitating its entry into the feed openings 36 which lead into the longitudinal wire slots 38 in the bit periphery. The slots 38 are preferably comprised of two contiguous bores 46 and 48 of different cross-section. The innermost bore 46 of smaller cross-section is adapted to accommodate the portion of the wire which has had its insulation removed, and the outermost bore 48, the insulated portion of the wire. It is thus apparent that the initial wraps of the wire 18 on the terminal 16 will be insulated therefrom. This is done to give a measure of strain relief to the wire, and to avoid an initial bend of the wire around the terminal at the point where the bare conductor enters the insulative jacket. This latter point is most susceptible to damage by nicking during the stripping of the insulation, and the wire is subject to breakage at this point during wrapping.

Figure 5:
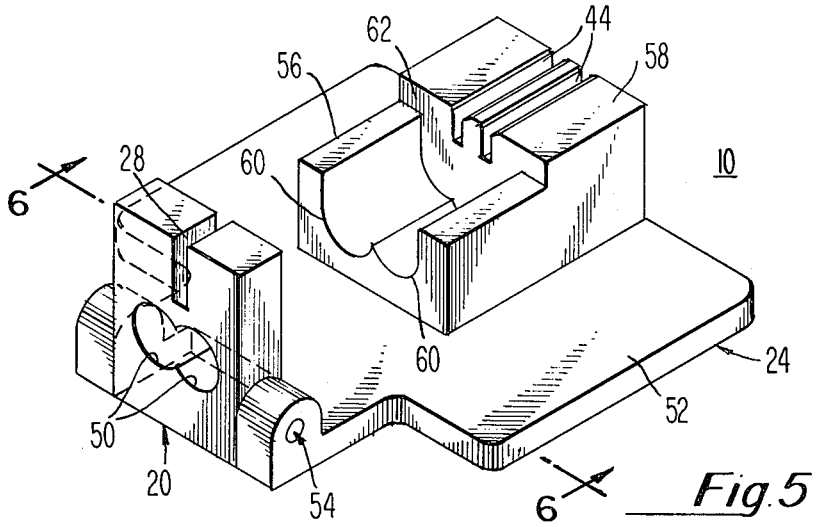
FIG. 5 is a pictorial view of the wire guide of the present invention.

FIG. 5 depicts the wire guide 10 of the present invention. The wire retention block 20 has a pair of intersecting circular apertures 50 through which the forward portion of the sleeves 22 of the wrap gun 12 pass. Further rearward, the sleeves taper into sections of larger cross sectional area, and the block 20 is press fitted onto this area. The groove 28 in block 20 is adapted to retain the wire 18 after the ends have been inserted in the wrapping bit feed openings 36. The grooves 28 also serves to centrally locate the wire pair to insure more balanced wraps.

Figure 6:
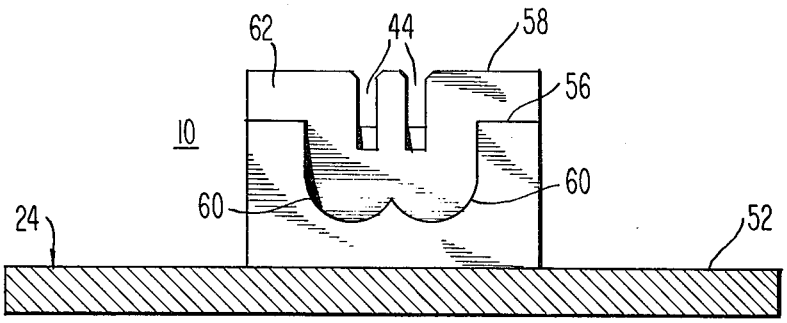
FIG. 6 is a section view taken along lines 6—6 of FIG. 5 to better illustrate the slotted section of the guide member.

The guide member 24 includes a base section 52 having at one extremity hinge means 54 coupled to the block 20. A pair of step-like projections 56 and 58 rise from the base section 52. As seen in FIG. 5, and also the section view of FIG. 6 derived therefrom, the first of these steps 56 contains a pair of contiguous semicylindrical depressions 60 to receive the respective sleeves 22 of the wrap gun 12 when the guide member 24 is in the load position. At this time, the ends of the gun sleeves 22 (FIG. 2) abut the riser area 62.

The second step 58 includes a pair of adjacent slots 44 of sufficient width to accommodate the outside diameter of the insulated wires 18 being used. The slots 44 are parallel with the longitudinal axes of the sleeves 22 and extend completely across the second step 58 from its outer extremity to the riser area 62. The top edges of the slots 44 are chamfered to facilitate entrance by the wires. The bottom edge of each of the slots 44 is arcuately shaped, as noted hereinbefore in connection with FIG. 4. The wire feed openings 36 are predeterminately positioned in substantial alignment with the slots 44.

In conclusion, it should be noted that although the previous description outlines a specific design of guide for a particular wrap gun, the basic principles taught herein may be applied to other similar wrap mechanisms which differ somewhat in construction or operation. It is further submitted that the wire guide of the present invention offers a simple, economical, time-saving means to facilitate the making of wire wrap electrical connections. As implied hereinbefore, changes and modifications of the guide may be needed to suit particular operating requirements. Such variations as are within the skill of the designer, and which do not depart from the true scope and spirit of the invention are intended to be covered by the following claims.

What is claimed is:

1. A retractable wire guide attachment for a front loading wire wrap gun which includes at least one wrapping tool bit having a wire feed opening and a terminal receiving aperture and wherein said wrapping bit is enclosed in a sleeve comprising:

a wire retaining block affixed to said sleeve, a guide member pivotally attached to said retaining block and being capable of assuming a load position in proximity to said wrapping bit and a retracted position away from said bit, said guide member having at least one slot in substantial alignment with said wire feed opening when said guide member is in said load position, said slot guiding the end of the wire to be wrapped into said feed opening, the terminal receiving aperture in said wrapping bit being blocked by said guide member in its load position to prevent the inadvertent insertion of said wire into said aperture.

2. A wire guide as defined in claim 1 further characterized in that said wire wrap gun is comprised of a pair of wrapping bits enclosed in respective sleeves, said wire retaining block being affixed to said sleeves, said guide member having a pair of slots for directing a pair of wires into the respective wire feed openings of said bits in order that they may be wrapped simultaneously by said gun.

3. A wire guide as defined in claim 2 wherein said sleeves are cylindrical in shape, said wire retaining block having a pair of intersecting circular apertures for receiving said sleeves, said block also having a centrally disposed groove therein for holding said wires after the ends thereof have been inserted into said wire feed openings in said wrapping bits.

4. A wire guide as defined in claim 3 wherein said guide member is comprised of a base section having at one extremity thereof hinge means coupled to said wire retaining block, a pair of step-like projections disposed one above the other on said base section, a first step having a pair of contiguous semicylindrical depressions to receive the respective sleeves of said wrap gun when the guide member is in said load position, a second step including a pair of adjacent slots disposed parallel with the longitudinal axes of said sleeves and in substantial alignment during loading with the respective wire feed openings of said wrapping bits, the extremities of said wrapping bits abutting the riser area between said steps when said guide member is in said load position, thereby blocking said terminal receiving apertures in said bits.

5. A wire guide as defined in claim 4 further characterized in that the bottom surface of each of said slots in said guide member has an arcuate shape to establish a trajectory for the wire which will facilitate its entrance into a wire feed opening.

6. A wire guide as defined in claim 5 further including a spring having one of its extremities fastened to the base section of said guide member and its other extremity fastened to a rigid surface such that the movement of said guide member to said load position and its retention in this position are in opposition to the spring force, the release of said guide member allowing said spring to return it to said retracted position.

7. A wire guide as defined in claim 6 further characterized in that said pair of wires includes the types known as "twisted pair" and "coax".

* * * * *